US007493704B2

(12) United States Patent
Bailey

(10) Patent No.: US 7,493,704 B2
(45) Date of Patent: Feb. 24, 2009

(54) TOOL FOR SCRIBING TILE

(76) Inventor: Michael Bailey, 121 Colbath, Poland, ME (US) 04274

( * ) Notice: Subject to any disclaimer, the term of this patent is extended or adjusted under 35 U.S.C. 154(b) by 42 days.

(21) Appl. No.: 11/541,754

(22) Filed: Oct. 2, 2006

(65) Prior Publication Data

US 2008/0052937 A1 Mar. 6, 2008

Related U.S. Application Data

(63) Continuation-in-part of application No. 11/009,676, filed on Dec. 10, 2004, now Pat. No. 7,117,610.

(51) Int. Cl.
*G01B 5/00* (2006.01)
*G01B 5/20* (2006.01)

(52) U.S. Cl. ..... 33/526; 33/561.1

(58) Field of Classification Search ..... 33/526, 33/527, 561.1

See application file for complete search history.

(56) References Cited

U.S. PATENT DOCUMENTS

| | | | | |
|---|---|---|---|---|
| 66,946 | A | 7/1867 | Burt et al. | |
| 2,144,697 | A | 1/1939 | Zangrando | |
| D136,978 | S | 1/1944 | Tomasini | |
| 2,424,042 | A | 7/1947 | Lundberg | |
| 2,612,700 | A | 10/1952 | Frisk | |
| 3,548,505 | A * | 12/1970 | Candilo | 33/527 |
| 4,353,171 | A | 10/1982 | Spears | |
| 4,899,455 | A | 2/1990 | Bovino et al. | |
| 4,928,391 | A | 5/1990 | Higgins et al. | |
| 4,965,935 | A | 10/1990 | Bourque | |
| 4,991,307 | A | 2/1991 | Higgins | |
| 5,188,013 | A | 2/1993 | Cardinale | |
| 5,293,694 | A | 3/1994 | Swindle | |
| 5,361,508 | A | 11/1994 | Ruggiero | |
| 5,560,274 | A | 10/1996 | Turner | |
| 5,617,642 | A | 4/1997 | Marios | |
| 5,701,680 | A | 12/1997 | Garcia et al. | |
| 6,195,904 | B1 * | 3/2001 | Greer | 33/527 |
| 6,481,112 | B1 | 11/2002 | White | |
| 6,523,272 | B1 | 2/2003 | Morales | |

(Continued)

FOREIGN PATENT DOCUMENTS

| | | |
|---|---|---|
| GB | 2036328 | 6/1980 |

(Continued)

OTHER PUBLICATIONS

Magic-Mark-It, www.tiletool.net, on sale as of Mar. 9, 2005.

*Primary Examiner*—Christopher W Fulton
(74) *Attorney, Agent, or Firm*—Pierce Atwood LLP; Kevin M. Farrell; Katherine A. Wrobel

(57) ABSTRACT

A tool for scribing tile includes a base member, a bottom member, and one or more bottom member opening. Further, bottom member is couplep to the base member through the one or more bottom member opening by at least one bottom fastener and slidable relative to the base member. The tool further comprises a center member defining at least one center member opening, wherein the center member is coupled to bottom member through the at least one center member opening by at least one center fastener and slidable relative to the bottom member.

10 Claims, 5 Drawing Sheets

U.S. PATENT DOCUMENTS

| | | | | |
|---|---|---|---|---|
| 7,117,610 | B2 * | 10/2006 | Bailey | 33/526 |
| 2001/0018856 | A1 | 9/2001 | Fouy | |
| 2003/0033724 | A1 | 2/2003 | Barbosa | |
| 2003/0196407 | A1 | 10/2003 | Rossi | |
| 2003/0235478 | A1 | 12/2003 | Stoscher et al. | |
| 2004/0025662 | A1 | 2/2004 | Torrents I Comas | |
| 2004/0030733 | A1 | 2/2004 | Bell | |

FOREIGN PATENT DOCUMENTS

| | | |
|---|---|---|
| GB | 2267757 | 12/1983 |

* cited by examiner

TOOL FOR SCRIBING TILE

CROSS-REFERENCE TO RELATED APPLICATIONS

This application is a continuation-in-part of Ser. No. 11/009,676 filed Dec. 10, 2004 now U.S. Pat. No. 7,117,610, issued on Oct. 10, 2006, the contents of which are incorporated herein by reference.

BACKGROUND OF THE INVENTION

1. Field of the Invention

The present invention relates to the measuring and cutting of tiles for installation. More specifically, the present invention relates to a tool for scribing a tile to be installed in a location and precisely determining the cut of the tile such that it fits into the installation location. When tiles are installed on a wall, floor or other surface, the tiles in the center of the surface can be installed as whole tiles, the tiles around the edges and/or around other objects such as door jams on the surface may have to be cut prior to installation to fit the surface being tiled.

2. Discussion of Background Information

Common practice for tiling surfaces today requires the repeated measurement of tiles, grouting, and distances to walls, moldings, and other obstructions. Large measuring devices that incorporate a cutting feature are often used for these purposes, thus requiring the repeated transport of often-heavy tiles from the machine to their destination. Moreover, each and every tile must be separately measured and cut, which increases the inefficiencies and risk of error in the endeavor.

Tile that is incorrectly measured, chipped, dropped, or otherwise mishandled cannot be used, and any wasted tile correlates to an increase in cost. Moreover, the increased time involved in moving, measuring, and cutting the tiles may also result in increased costs, and thus the user may find himself in a dilemma. Professional tile installation is expensive, and a good deal of those costs is attributable to the labor associated with the task. On the other hand, the user suffers from a lack of reliable and cost-efficient tools on the market to do the tiling himself. As such, there is a need in the art for an economical and efficient tool that can be used by anyone, professional or otherwise, who needs to reliably and quickly measure, mark and place a series of tiles around a number of orientations and obstacles.

Accordingly, the present invention includes a tool for scribing tile that is readily adaptable for use by those wanting to tile a surface in a precise and economical fashion. In particular, the present invention includes a base member that defines a substantially planar surface, preferably rectangular in design, and more preferably with a small cutout in one end for particular applications. The base member preferably approximates the size of a tile to be laid. The base member is slidably coupled to a series of edge members and center members that are movable with respect to each other, as well as the base member. The edge and center members are slidably fastened to the base member, thus permitting the tool to mimic a number of shapes and sizes depending upon the shape and size of tile to be cut.

In operation, the tool of the present invention provides an efficient and reliable manner for scribing tile. The tool can be adjusted such that its dimensions are representative of a tile and the surrounding grout. A fresh tile is then placed directly on top of a previously laid tile, and the tool is disposed on the fresh tile such that the tool abuts a wall on one end and partially exposes the fresh tile on the other end. The portion of the fresh tile that is exposed is the same shape as the tile that is to be laid, including any room for grout.

Moreover, unlike much of the existing art, the tool of the present invention can be used against flat walls, angled walls, corners and door jams. Of particular note is that the present invention contains a plurality of moving members that are all movable relative to each other and to the base member. In embodiments discussed below, the members can be oriented to conform to the shape of flat surfaces, corners and door jams. Thus, the members can be oriented in a planar fashion to represent a rectangular plate, or the members can be moved independently for scribing tile in difficult circumstances, such as a door jam. In sum, the present invention is an economical and useful tool that is adaptable for a number of uses in the art of tile scribing.

SUMMARY OF THE INVENTION

The present invention is directed to a tool for scribing tile comprising a base member and a bottom member. The bottom member includes one or more bottom member opening, such that the bottom member is coupled to the base member through the one or more bottom member opening by at least one bottom fastener and slidable relative to the base member. The tool further comprises a center member defining at least one center member opening, wherein the center member is coupled to bottom member through the at least one center member opening by at least one center fastener and slidable relative to the bottom member.

According to an aspect of the invention, the tool further comprises a plurality of measuring marks positioned on one of the bottom member, the center member and the base member.

According to an aspect of the invention, the tool includes the center member coupled to base member through the at least one center member opening and the one or more bottom member opening by the center fastener, such that the center member is slidable relative to the bottom member. Further, the bottom member can be slidably enagable with the base member and center member.

According to an aspect of the invention, the tool further comprises at least one lip defined on the base member, wherein the lip defines a lip passage through which the center member may pass. It is also possible the tool further comprises at least one base member passage defined on the base member approximate the lip passage.

According to an aspect of the invention, the tool further comprises one or more skirts defined on the base member.

According to another embodiment of the invention, the present invention is scribing tool for scribing tile. The scribing tool comprises a base member having at least one passage. Further, scribing tool comprises a bottom member defining one or more bottom member opening, such that the bottom member is slidably attached to the base member through the one or more bottom member opening by at least one bottom fastener. Further still, the scribing tool comprises a center member defining at least one center member opening, wherein the center member is slidably attached to bottom member through the at least one center member opening by at least one center fastener. The scribing tool further includes at least a portion of the center member extending through the passage.

According to another embodiment of the invention, the present invention is tile scribing tool for scribing tile. The tile scribing tool comprises a base member having at least one lip. The tile scribing tool includes a bottom member defining one or more bottom member opening, such that the bottom member is slidably enagable with the base member through the one or more bottom member opening by at least one bottom fastener. Further, the tile scribing tool includes a center member defining at least one center member opening, such that the center member is slidably enagable with bottom member through the at least one center member opening by at least one center fastener. Further still, the tile scribing tool includes at least a portion of the bottom member that engages the lip of the base member.

The foregoing is intended as a summary of the novel and useful features of the present invention. Further aspects, features and advantages of the invention will become apparent from consideration of the following detailed description and the appended claims when taken in connection with the accompanying drawings. Further, other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention is directed to a tool for scribing tile comprising a base member and a bottom member. The bottom member includes one or more bottom member opening, such that the bottom member is coupled to the base member through the one or more bottom member opening by at least one bottom fastener and slidable relative to the base member. The present invention further comprises a center member having at least one center member opening, wherein the center member is coupled to bottom member through the at least one center member opening by at least one center fastener and slidable relative to the bottom member.

Figure 1:
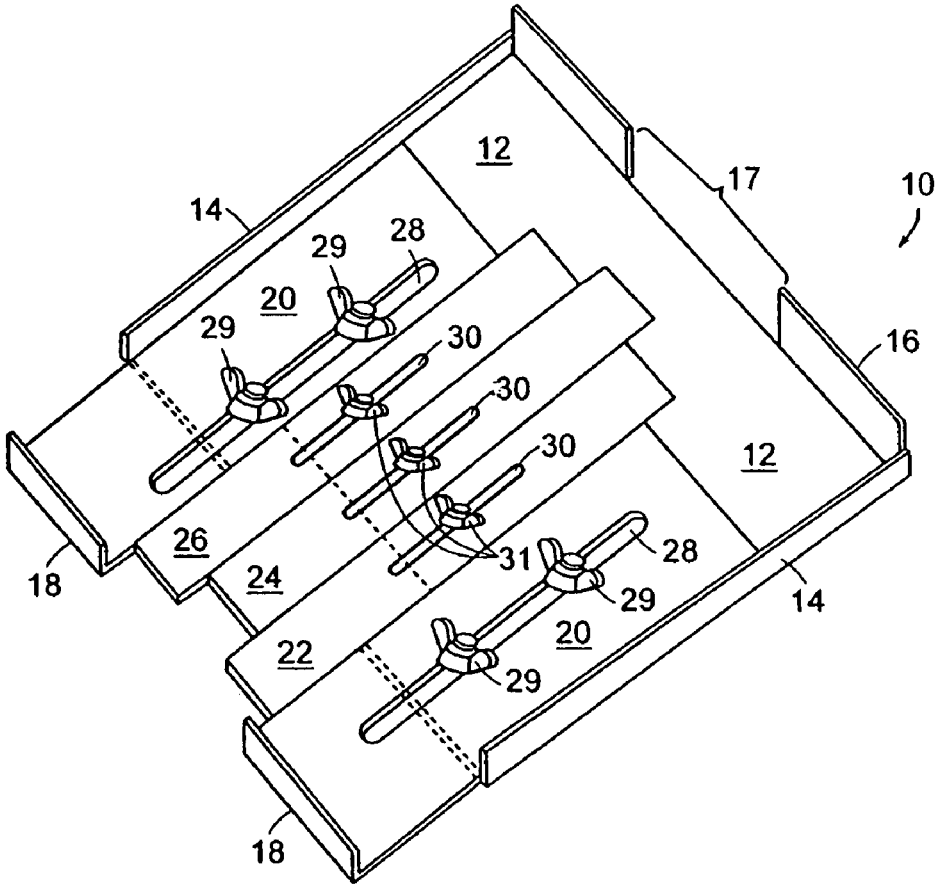
FIG. 1 is a perspective view of the tool for scribing tile of the present invention.
Figure 2:
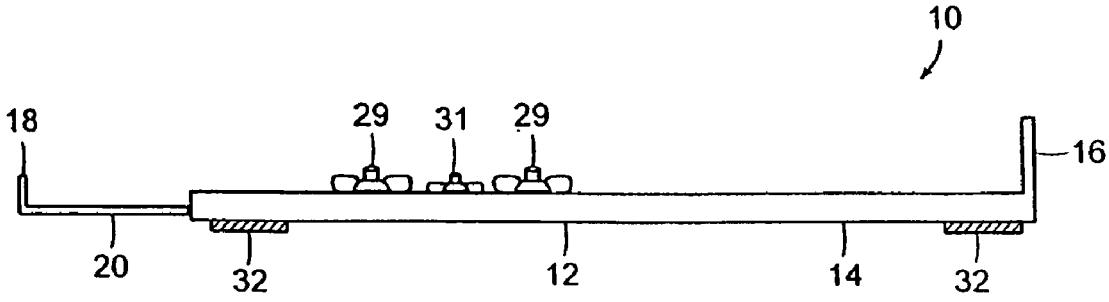
FIG. 2 is a cross-sectional view of the tool for scribing tile of the present invention.

Referring to FIGS. 1 and 2, a tool 10 for scribing tile is shown in one of its preferred embodiments. As illustrated in the plan view of FIG. 1, the tool 10 includes a base member 12 that defines a substantially planar surface. The base member 12 is preferably rectangular in design, and more preferably has a small cutout in one end (shown in phantom in FIG. 1). The base member 12 preferably approximates the size of a tile to be laid. Thus, the exact size of the base member 12 will vary depending on the application for which it is used. The base member 12 may be skirted on its edges by skirts 14. A lip 16 defining a passage 17 is also shown on one end of the base member 12. As shown in FIG. 2, the base member 12 may have a plurality of feet 32 disposed on its bottom side for secure and stable placement on a tile to be scribed.

A pair of edge members 20 is slidably disposed on opposing sides of the base member 12. The edge members 20 define edge openings 28 that are preferably oblong in shape. The edge members 20 are slidably attached to the base member 12 by fasteners 29. In one embodiment, the fasteners 29 would comprise bolts that project from the base member 12 through the edge openings 28, to which wingnuts or other securing mechanisms could be attached. It should be understood that the fasteners 29 can be selectively engaged, and disengages such that the edge members 20 are movable with respect to the base plate 12, and the direction and degree of movement is determined by the edge openings 28. The edge members 20 define lips 18 that are similar to the skirts 14 and lip 16 discussed above.

The tool 10 also includes a plurality of center members 22, 24, 26 that are disposed on the base member 12 between the edge members 14. The center members 22, 24, 26 define center openings 30 that are preferably oblong in shape. The center members 22, 24, 26 are slidably attached to the base member 12 by fasteners 31. In one embodiment, the fasteners 31 would comprise bolts that project from the base member 12 through the center openings 30, to which wingnuts or other securing mechanisms could be attached.

In a preferred embodiment, there are three center members 22, 24, 26 on a tool 10 for permitting the use of the tool 10 against a door jam, as discussed in greater detail below. It should be understood that the fasteners 31 can be selectively engaged, and disengages such that the center members 22, 24, 26 are movable with respect to the base plate 12, and the direction and degree of movement is determined by the edge openings 28. The center members 22, 24,.26 are also independently movable with respect to each other, as well as with respect to the edge members 20. In particular applications discussed below, the center members 22, 24, 26 are passable through the passage 17, thus permitting the tool 10 to be used in situations in which the tile to be cut is not rectangular in profile.

Figure 3A:
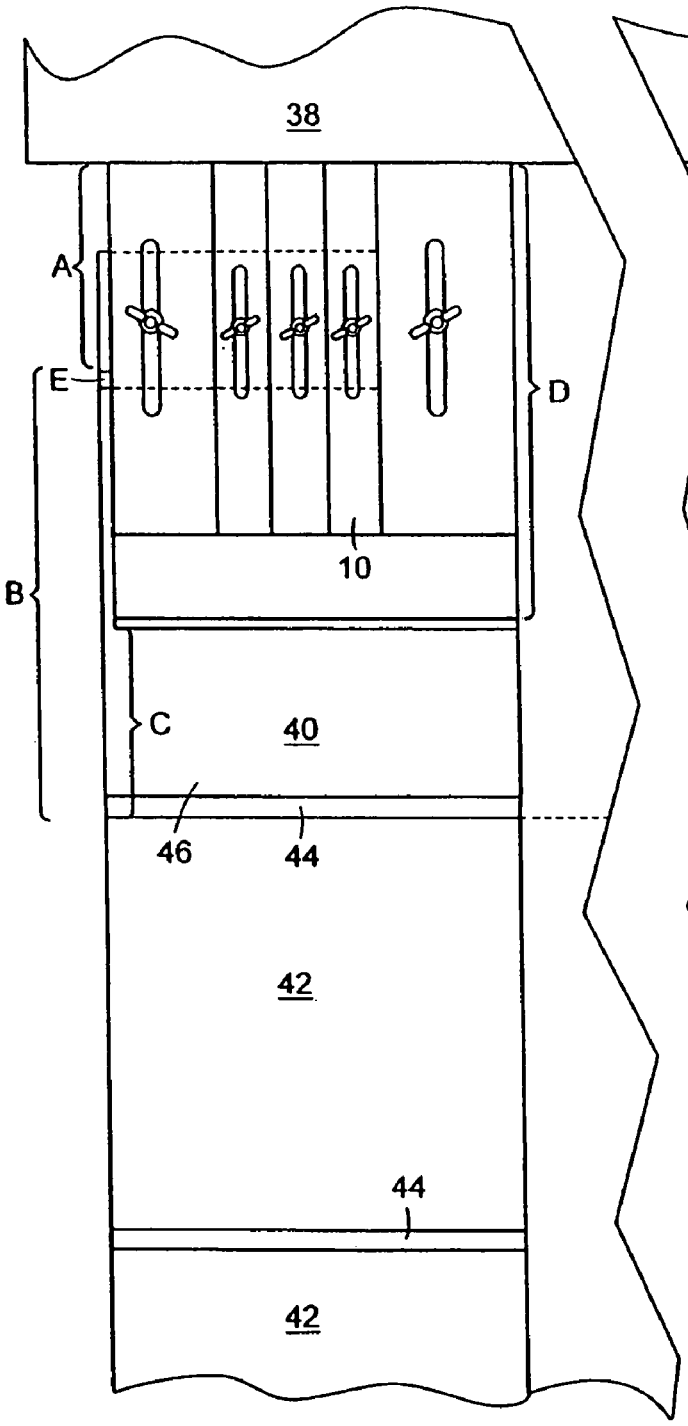
FIGS. 3A and 3B are a split view of the present invention in use showing a schematic plan view of the tool and a schematic cross-sectional view of the tool.
Figure 3B:
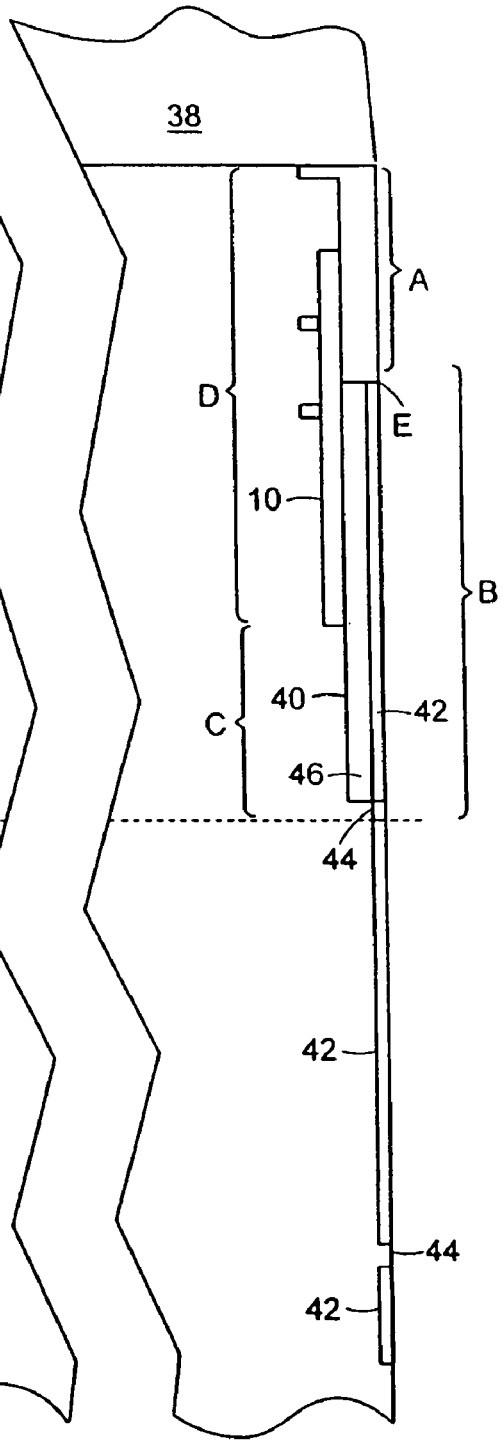

FIGS. 3A and 3B are a split schematic view of the present invention in use showing a plan view of the tool and a cross-sectional view of the tool 10. Referring to both Figures now, the tool 10 is shown placed on a series of placed tile 42, which is typically separated by grout 44. A wall 38 or other structure that is not to be tiled is partially shown as well.

In operation, the tool 10 of the present invention provides an efficient and reliable manner for scribing tile. A fresh tile 40 is placed directly on top of the tile 42 that is nearest the wall 38, where a tile is to be inserted in space A. The tool 10 is then placed directly over the fresh tile 40 such that it abuts the wall 38 on one end and partially exposes the fresh tile 40 on the other end. The length B is the gross length of the tile 42, as well as any surrounding grout 44 and any space left for grouting the fresh tile 40 defined by space E. When the tool 10 is extended to its required length D, the fresh tile 40 that remains exposed will be of length C. Length C is equal to length A, and therefore, the user may mark or scribe the fresh tile 42 along the junction between the tool 10 and the fresh tile 40 and make a reliable cut, thereby creating a new tile portion 46 that is designed to fit in space A, including any grout 44 that is required.

Figure 4:
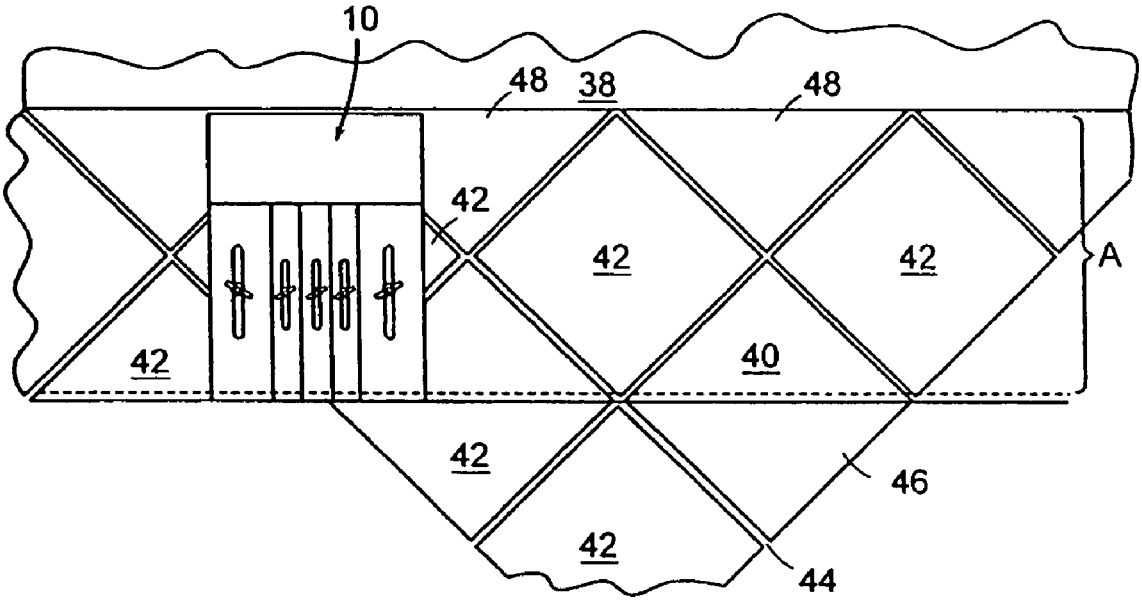
FIG. 4 is a plan view of the present invention in use at an angle to a wall.
Figure 5:
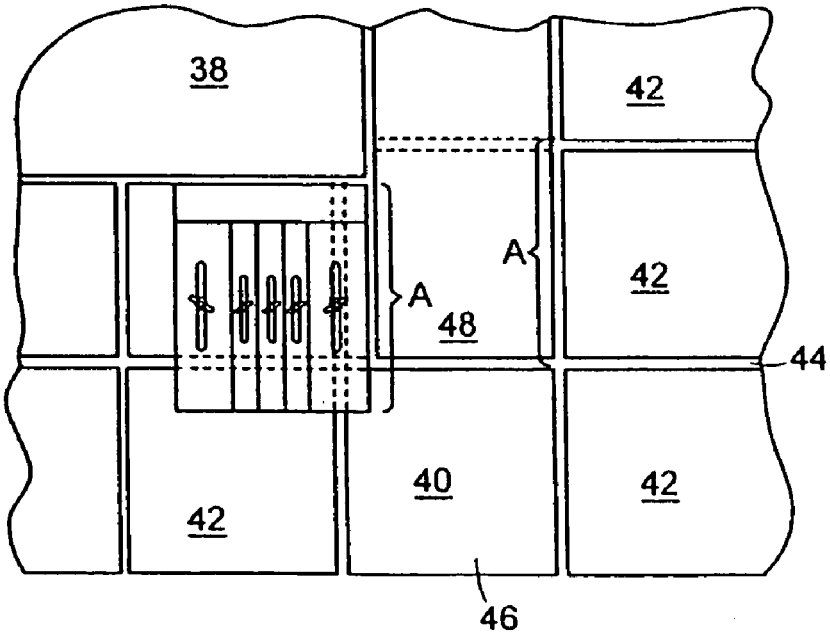
FIG. 5 is a plan view of the present invention in use around the corner of a wall.

Turning to FIGS. 4 and 5, it is shown that the tool 10 of the present invention is also readily adaptable for handling situations in which the empty space 48 is angled relative to the wall 38 (FIG. 4), or in which the empty space 48 wraps around the corner of a wall 38 (FIG. 5). In FIG. 4, the tool 10 is shown extended to a length A that corresponds to the diagonal dimensions of a tile 42 including any surrounding grout 44. A fresh tile 40 can be cut along a line perpendicular to the length of the tool 10 to create a new tile 46 that is shaped to fit in a plurality of spaces 48 along the wall 38. It is understood that this process can be repeated indefinitely to tile entire surfaces along the wall 38.

In FIG. 5, the space 48 is partially filled by the corner of the wall 38. In such a case, the tool 10 is similarly extended to a length A that includes the dimensions of tile 42 including any grout 44 that is required. A fresh tile 40 is then disposed below the space 48, and the tool 10 is aligned with the corner of the wall 38 as shown. The cut of fresh tile 48 will render a new tile 46 that is fitted to the space 48, including any grout 44 as noted above.

Figure 6:
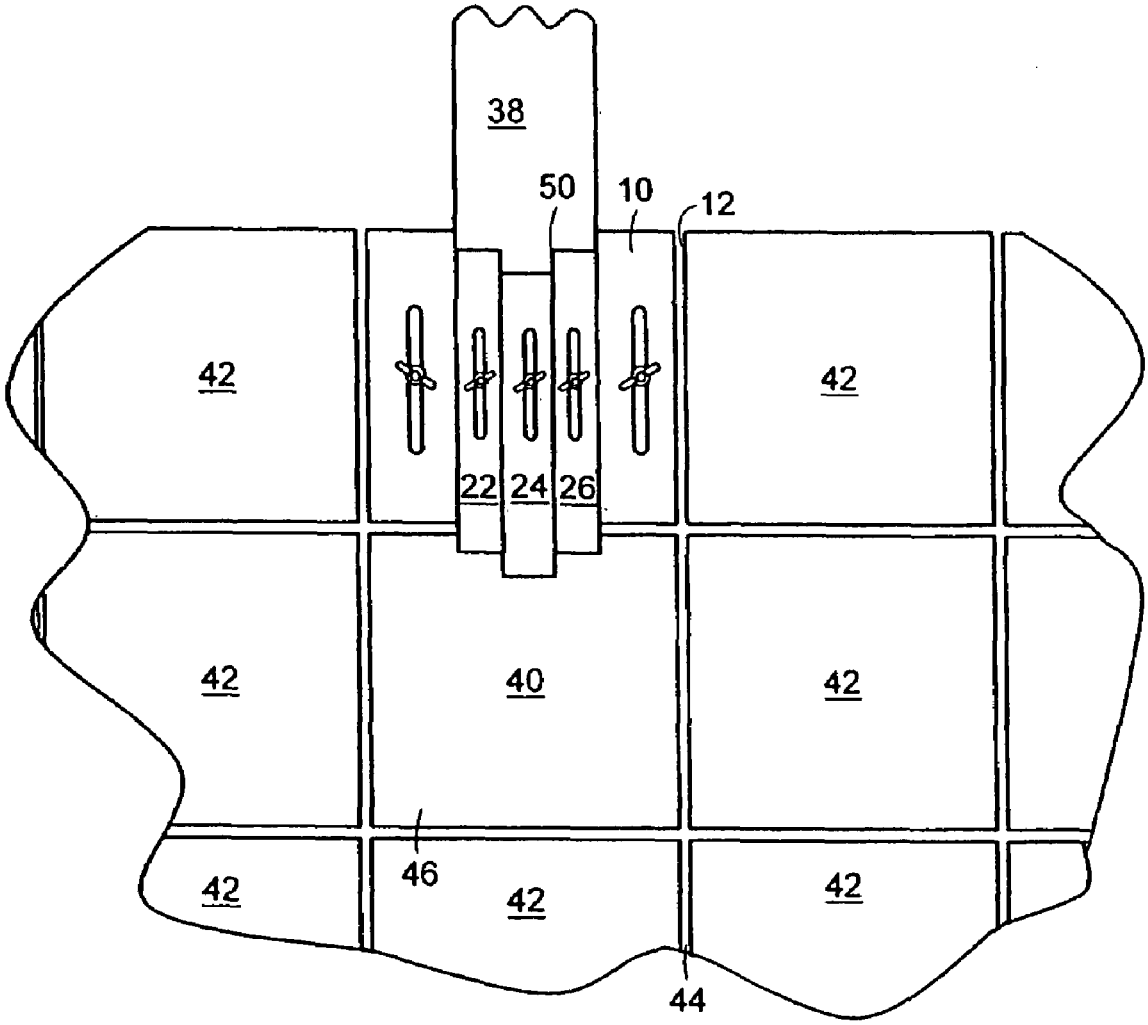
FIG. 6 is a plan view of the present invention in use around a door jam.

A particular application for which the tool 10 of the present invention is well-suited is tiling around a door jam as depicted in FIG. 6. In this instance, the wall 38 terminates in a door jam 50 of the type known in the art. Unlike existing tools for scribing tile, the present invention includes center members 22, 24, 26 that may be displaced relative to the base member 12 to accommodate the profile of the door jam 50. As in previous instances, the tool 10 is fitted to the contours of the door jam 50 and a fresh tile 40 is disposed such that the tool 10 partially overlaps it. The resultant new tile 46 will be fitted to the outline of the door jam 50, including any grout 44 that is necessary.

As described herein, the tool 10 of the present invention provides a reliable and consistent means for measuring and cutting tile to be fitted across a varying set of circumstances. The present invention can be used against flat walls, angled walls, corners, and door jams. Of particular note is that the present invention contains a plurality of moving members, including the edge members 20 and the center members 22, 24, 26 that are all movable relative to each other and to the base member 12. Thus, the edge members and center members 22, 24, 26 can be moved in concert to mimic a rectangular plate, as shown in FIGS. 3A, 3B, or the members can be moved independently for scribing tile in difficult circumstances, such as those described with reference to FIG. 6. In sum, the present invention is an economical and useful tool that is adaptable for a number of uses in the art of tile scribing.

Figure 7:
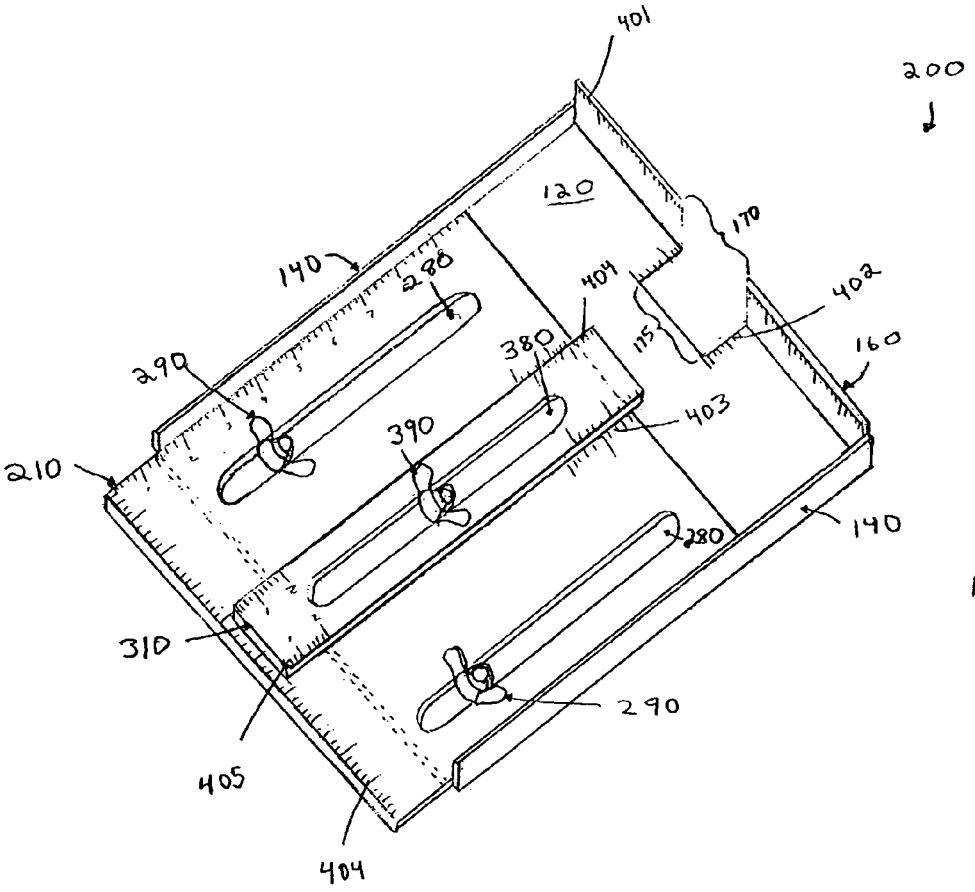
FIG. 7 is a perspective view of another embodiment of the tool for scribing tile.
Figure 8:
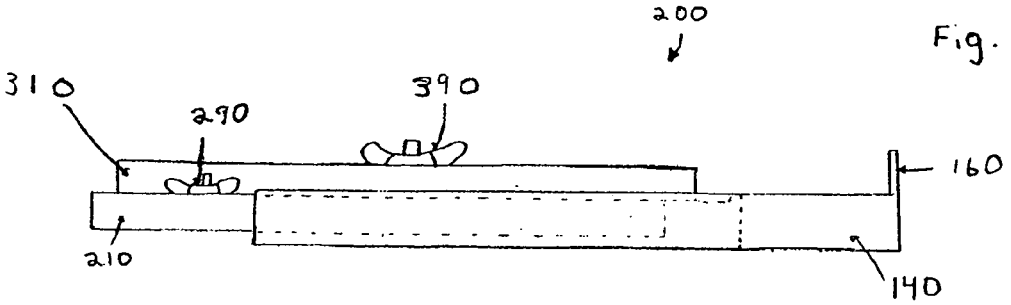
FIG. 8 is a cross-sectional view of the tool as shown in FIG. 7 for scribing tile.

According to another embodiment of the invention, FIGS. 7 and 8 disclose a tool 200 for scribing tile. FIG. 7 shows the tool 200 having a base member 120 that defines a substantially planar surface. The base member 120 is preferably rectangular in design, and more preferably has a lip 160 with a small lip cutout or lip passage 170 in one end (shown in phantom in FIG. 7). The base member 120 includes a base member passage 175 positioned approximate the lip passage 170. The base member 120 preferably approximates the size of a tile to be laid. Thus, the exact size of the base member 120 can vary depending on the application for which it is used. The base member 120 may include on its edges one or more skirts 140 so as to guide the bottom member 210 in a upward and downward direction relative to the lip 160. For example, the lip passage 170 and base member passage 175 may be the approximate width of a door jam, whereby the door jam fills the passage 170 and base member passage 175 to allow for scribing the tile. It is possible the base member 120 can have a plurality of feet (not shown) disposed on its bottom side for secure and stable placement on the floor.

FIG. 7 shows a bottom member 210 slidably disposed on the base member 120. The bottom member 210 includes one or more bottom member opening 280 that is preferably oblong in shape. For example, FIG. 7 shows the bottom member having two bottom member openings 280. The bottom member 210 is slidably attached to the base member 120 by fasteners 290. In one embodiment, the fasteners 290 can comprise of a bolt which projects from the base member 120 through the bottom member opening 280, to which a wingnut or other securing mechanism may be attached. It is possible the fastener 290 can be selectively engaged, and disengaged such that the bottom member 210 can be movable with respect to the base member 120, and the direction and degree of movement is determined by the bottom member opening 280. The bottom member 200 may define lips (not shown) that are similar to the skirts 140 and lip 160 discussed above to assist in slidably guiding bottom member 210.

FIGS. 7 and 8 shows the tool 200 including a center member 310 slidably disposed on top of the bottom member 210. The center member 310 includes a center member opening 380 that can be preferably oblong in shape. The center member 310 is slidably attached to the bottom member 210 by fasteners 390. Further, it is possible the bottom member 210 can be provided with a channel (not shown) for the center member to be placed, so as to slidably guide the center member in a upward and downward direction relative to the lip 160. For example, the channel (not shown) can be milled (and/or by any other method known to one skilled in the art) into the bottom member 210 to guide the center member 310 in an upward direction and/or a downward direction relative to lip 160.

In one embodiment, the fastener 390 may comprise a bolt that projects from bottom member 210 through the center opening 380, to which a wingnut or other securing mechanism can be attached. In another embodiment, the fastener 390 may comprise a bolt that projects from the base member 120 through the bottom member opening 280, as well as through the center member opening 380, to which a wingnut or other securing mechanism can be attached. Further, it is possible one or more tension devices (not shown) may be threaded from underneath the base member 120, wherein the tensioning device applies pressure to the bottom member 210, securing the bottom member from movement. For example, a screw may be threaded into the base member 120 from the underside, wherein by tightening of the screw applies pressure from the underside of the base member 120 to the underside of the bottom member 210 so as to secure the bottom member 210.

In a preferred embodiment, there is one center member 310 on the tool 200 for permitting the use of the tool 200 against a door jam, as discussed in greater detail below. It should be understood that the fastener 390 can be selectively engaged, and disengaged such that the center member 310 is movable with respect to the bottom member 210, and the direction and degree of movement is determined by the center member opening 380. In particular applications discussed below, the center member 310 can be passable through the lip passage 170, thus permitting the tool 200 to be used in situations in which the tile to be cut is not rectangular in profile. Further, the tool 200 includes a base member passage 175 positioned approximate the lip passage 170.

Still referring to FIG. 7, it is possible the present invention includes measuring marks 401-405 placed on the tool 200 to improve the scribing process. Further still, it is possible that the bottom member 120 may have a second lip (not shown) on the end opposite the end of the bottom member 210 adjacent the lip 160. The present invention may further include a detachable device to hold or retain a pencil or marking device holder on the tool.

It is noted that the foregoing examples have been provided merely for the purpose of explanation and are in no way to be construed as limiting of the present invention. While the present invention has been described with reference to an exemplary embodiment, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A tool for scribing tile comprising:

a base member;

a bottom member defining one or more bottom member opening, the bottom member coupled to the base member through the one or more bottom member opening by at least one bottom fastener and slidable relative to the base member;

a center member defining at least one center member opening, the center member coupled to the bottom member through the at least one center member opening by at least one center fastener and slidable relative to the bottom member; and wherein the center member is coupled to the base member through the at least one center member opening and the one or more bottom member opening by the center fastener and the center member is slidable relative to the bottom member.

2. The tool of claim 1, further comprising a plurality of measuring marks positioned on one of the bottom member, the center member and the base member.

3. The tool of claim 1, further comprising at least one lip defined on the base member.

4. The tool of claim 3, wherein the lip defines a lip passage through which the center member may pass.

5. The tool of claim 1, further comprising at least one base member passage defined on the base member.

6. The tool of claim 1, wherein the bottom member includes at least one channel to guide the center member.

7. The tool of claim 1, further comprising one or more skirts defined on the base member.

8. A scribing tool for scribing tile comprising:

a base member having at least one passage;

a bottom member defining one or more bottom member opening, the bottom member slidably attached to the base member through the one or more bottom member opening by at least one bottom fastener; and a center member defining at least one center member opening, the center member slidably attached to bottom member through the at least one center member opening by at least one center fastener;

wherein at least a portion of the center member extends through the passage.

9. A tile scribing tool for scribing tile comprising:

a base member having at least one lip;

a bottom member defining one or more bottom member opening, the bottom member slidably enagable with the base member through the one or more bottom member opening by at least one bottom fastener;

a center member defining at least one center member opening, the center member slidably enagable with bottom member through the at least one center member opening by at least one center fastener;

wherein the center member is coupled to the base member through the at least one center member opening and the one or more bottom member opening by the center fastener;

and wherein at least a portion of the bottom member engages the at least one lip of the base member.

10. The tool of claim 9, further comprising a plurality of measuring marks positioned on one of the bottom member, the center member and the base member.

* * * * *